United States Patent [19]

Bielagus

[11] Patent Number: 4,972,959

[45] Date of Patent: Nov. 27, 1990

[54] COMPRESSIBLE RING SPACER DISK SCREEN

[75] Inventor: Joseph B. Bielagus, Tualatin, Oreg.

[73] Assignee: Beloit Corporation, Beloit, Wis.

[21] Appl. No.: 443,984

[22] Filed: Nov. 30, 1989

[51] Int. Cl.[5] ..... B07B 1/16

[52] U.S. Cl. ..... 209/672; 209/667; 403/225

[58] Field of Search ..... 209/672, 667, 668, 670, 209/671; 198/382; 403/224, 225; 411/150

[56] References Cited

U.S. PATENT DOCUMENTS

| | | | |
|---|---|---|---|
| 1,524,360 | 1/1925 | Lauritzen | 209/671 |
| 2,565,606 | 8/1951 | Guy | 403/224 X |
| 2,771,312 | 11/1956 | Thiry | 403/224 X |
| 4,301,930 | 11/1981 | Smith | 209/672 |
| 4,377,474 | 3/1981 | Lindberg | 209/672 |
| 4,653,648 | 3/1987 | Bielagus | 209/672 |
| 4,741,444 | 5/1988 | Bielagus | 209/672 |
| 4,755,286 | 7/1988 | Bielagus | 209/672 |

*Primary Examiner*—Donald T. Hajec

*Attorney, Agent, or Firm*—Dirk J. Veneman; Raymond W. Campbell

[57] ABSTRACT

A disk screen or like shaft structure is disclosed in which screen disks and spacer rings are connected together in modular relation. The spacer rings consist of resilient plastic annular rings spaced around the periphery of a shaft and intermediate between screen disks so as to accommodate limited tilting of the disks relative to the axis of the shaft with deflection of the spacer rings. The flexible spacer rings allow foreign objects to work their way out of the disk screens and not become lodged between neighboring screen disks. Metallic surround may be provided to protect the plastic spacer rings from scratching and gouging.

11 Claims, 3 Drawing Sheets

COMPRESSIBLE RING SPACER DISK SCREEN

FIELD OF THE INVENTION

The present invention relates to disk screens in general and to disk screens with flexible spacers in particular.

BACKGROUND OF THE INVENTION

Disk screens are utilized for screening or classifying discrete materials such as wood chips, municipal wastes, and the like. Disk screens are commonly used in the paper industry to separate wood chips on the basis of size prior to pulping. Disk screens have a screening bed with a series of co-rotating spaced parallel shafts, each of which has a longitudinal series of concentric screen disks which interdigitate with the screen disks of the adjacent shafts. Spaces between the disks permit only material of a specified size or smaller size to pass downwardly through the bed of rotating disks. On flat screens, such as U.S. Pat. No. 4,301,930, and split screens, such as U.S. Pat. No. 4,755,286, the disks are driven to rotate in a direction from the infeed end of the screen bed to the outfeed or discharge end of the bed, with the general direction of material flow being perpendicular to the shafts. The particles of material which are larger than the specified size will be advanced on the bed to the outfeed end of the bed and rejected. In so-called V-screens as disclosed in U.S. Pat. No. 4,377,474 the chip flow is generally parallel to the shafts.

Disk screens in which the screen disks are rigidly attached to a central shaft by a method such as welding are susceptible to damage when, in the course of normal usage, foreign objects such as large chips, rock, spurious metal, or other objects enter the screen and lodge between the disks, becoming trapped. If the screen disks are not free to flex so that oversized chips and other foreign objects may be dislodged, breakage or permanent distortion of the disk screen is likely to result.

Disk screens constructed with resilient plastic spacers intermediate between the screen disks, such as the disk screen disclosed in U.S. Pat. No. 4,653,648 alleviate the problems inherent in a rigid disk screen assembly. Prior spacers are usually solid disks of plastic material with portions removed to permit through-bolts for clamping the spacers within the disk screen assembly. Surrounds are known for covering exposed plastic spacers with metal in applications where contamination by plastic is undesirable or where abrasion and deterioration of the plastic may occur prematurely. Use of a metallic surround encircling a resilient spacer is taught in U.S. Pat. No. 4,741,444. Disk screen spacers requiring less plastic material and having a simple geometric shape would advantageously lower costs and conserve resources.

SUMMARY OF THE INVENTION

The disk screen of this invention has an elongate metallic shaft member and a plurality of screen disks mounted co-rotatively on the shaft member, each screen disk having central shaft receiving openings complementary to the shaft member. The disks are mounted in spaced relation axially along the shaft member. The disk screen has at least three non-metallic spacer rings between each pair of adjacent screen disks, the spacer rings being spaced around the periphery of the shaft with the spacer rings adjacent the shaft and between the screen disks, so as to accommodate limited tilting of the disks relative to the axis of the shaft with the deflection of the spacer rings. Axially extending pins compressively connect the disks and spacer rings together in a modular unit which can be supported on the shaft member. Metallic surrounds encircling sets of spacer rings are optionally provided.

It is an object of the present invention to provide a disk screen with lightweight plastic spacers between screen disks.

It is a further object of the present invention to provide a disk screen with easily manufactured plastic spacers.

A still further object of the invention is to provide a disk screen wherein the disks are somewhat elastically supported, so as to be able to deflect out of their radial planes on a temporary basis to accommodate lumpy foreign elements and automatically return to their radial planes after the foreign elements have been discharged.

Further objects, features, and advantages of the invention will be apparent from the following detailed description taken in conjunction with the accompanying drawings.

DESCRIPTION OF THE PREFERRED EMBODIMENT

Figure 1:
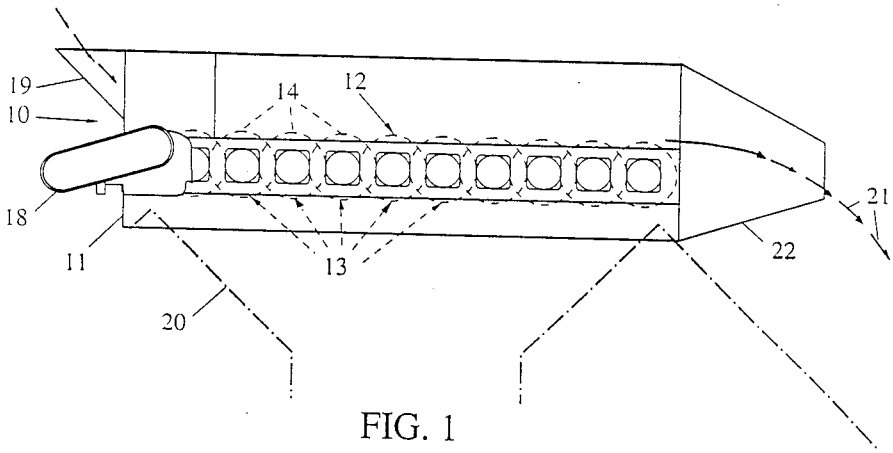
FIG. 1 is a schematic side-elevational view of a disk screen apparatus embodying the features of the invention.

Referring now to the FIGS. 1-6 wherein like numbers refer to like parts, FIG. 1 shows a disk screen apparatus 10 having a frame 11 supporting a screening bed 12 which has a series of co-rotating spaced parallel shaft assemblies 13 of cylindrical perimeter and similar length, and each of which has a longitudinal series of coaxial metal screen disks 14. The disks 14 of each of the shaft assemblies 13 interdigitate with the disks of the adjacent shafts. Each of the shaft assemblies 13 is rotatably mounted on the frame 11. Unison driving of the shaft assemblies 13 in the same direction, clockwise as seen in FIG. 1, is adapted to be effected by suitable drive means 18. Screen apparatus 10 is described herein as a flat screen; however, the present invention can be used equally advantageously as split-flow screens, V-screens and the like.

Figure 3:
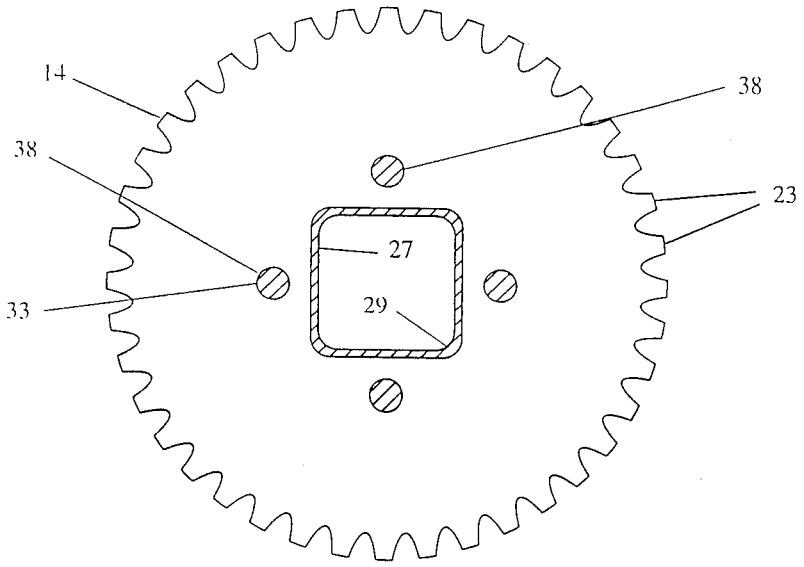
FIG. 3 is a cross-sectional view taken along section line 3—3 of FIG. 2 on a plane running between the ring spacers and a disk screen.
Figure 4:
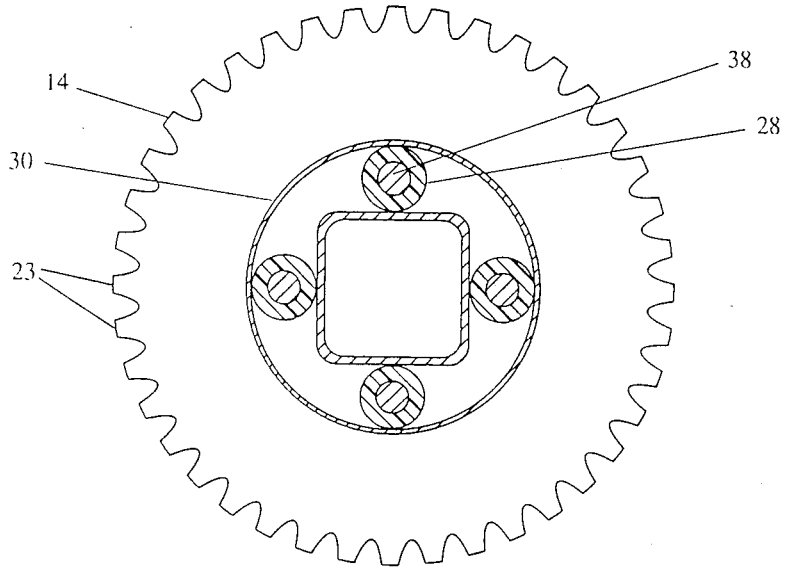
FIG. 4 is a cross-sectional view taken along section line 4—4 of FIG. 2.

Discrete material to be screened is delivered to the infeed end of the screening bed 12 by means of a chute 19. Acceptable size particles drop through screening slots defined by and between the interdigitated portions of the disks 14, and are received in a hopper 20. Particles which are too large to pass through the screening slots are advanced to and discharged, as indicated by directional arrows 21, from the rejects end of the screenng bed as by means of an outfeed chute 22. The screening function of the disks 14 may be enhanced by a uniform generally sawtooth configuration of the outer perimeter of the screen disks 14 provided by teeth 23, as best seen in FIGS. 3 and 4. The number of such teeth and their size may be dictated by the particular material to be processed. Although shown as having a relatively short, sawtooth shape, the teeth 23 may, depending upon use, be of different geometric forms, such as lobulate or the like.

Each of the disks 14 is spaced from each adjacent disk throughout the entire set of disks in each of the shaft assemblies 13, to provide the desired screening slot spaces between the annular interdigitated disks.

Figure 2:
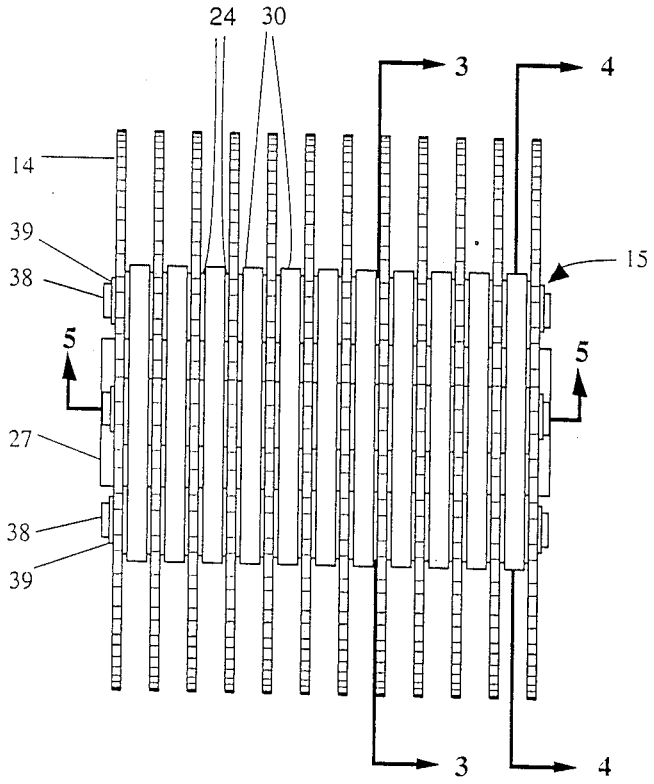
FIG. 2 is an enlarged side-elevational view of one of the disk screen modules of the apparatus of FIG. 1.
Figure 5:
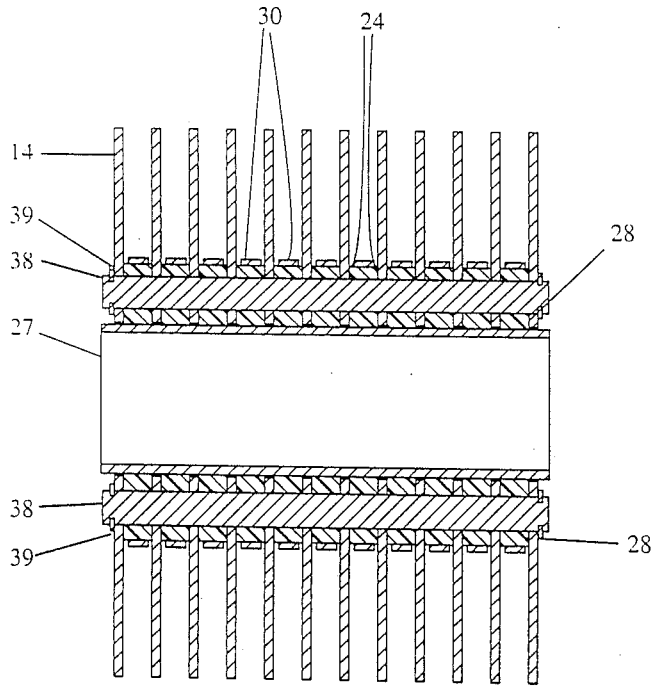
FIG. 5 is a cross-sectional view taken along section line 5—5 of FIG. 2.

As best shown in FIGS. 2 and 5, a plurality of screen disks 14 are provided which are mounted in a module assembly 15 in axial spaced relation to provide spaces therebetween. The screen disks each extend in relatively parallel planes radially from a shaft 27, being held in their spaced relationship but permitted to tilt or cock slightly when a foreign element is wedged between the disks.

For maintaining the screen disks 14 in their module 15, non-metallic spacer rings or sleeves 28, as shown in FIG. 4, are mounted between adjacent screen disks 14 on pins 38 running through aligned pin holes 33 in the screen disks 14. The pin holes are spaced outwardly from the shaft-receiving openings 29 in the screen disks 14, so that the spacer rings 28 are spaced around the periphery of the shaft 27 and are adjacent to the shaft 27. The spacer rings 28 are preferably of polyurethane material such as a polyurethane 90 A Durometer, but may be of any suitable hard compressible plastic material.

The plastic spacer rings or sleeves 28 have end faces that press against the screen disks 14 and hold them in their radial planes, the pin holes 33 of the screen disks 14 being of sufficient dimension to accommodate the pins 38 passed therethrough but not the spacer rings or sleeves 28 disposed on the pins 38. The plastic of the spacer rings or sleeves 28 is sufficiently resilient when subjected to the large forces which would be caused by a particle wedging between the screen disks that the screen disks can deflect to allow the particle to be discharged and then return to their original positions which are in parallel planes extending radially from the shaft. To provide this compressive restorative force, the series of screen disks 14 and spacer rings 28 are compressed by a predetermined axial force by clamping the screen disks 14 and the spacer rings 28 on the pins 38. A means for clamping the module 15 is shown in FIG. 2. An axial force is applied on opposite ends of the module against the end screen disks 14 by the pins 38 which extend through the spacer rings or sleeves 28 and the pin holes 33 in the screen disks 14. Locking rings 39 rest in grooves at the ends of the pins 38 and hold the module 15 in a tight unit. The clamping means acts to axially compressively connect the screen disks 14 and the spacer rings 28 and secure them in a modular unit which can be engaged and supported on the shaft 27.

The spacer rings or sleeves 28 are uniform, annular, resilient plastic rings with an outer diameter which is small in comparison to the diameter of the screen disks 14. The inner diameter of each spacing ring 28 is dimensioned to accommodate a pin 38. Each pair of screen disks 14 may be separated by as few as three spacer rings 28, but for a shaft 27 of generally rectangular cross section, four spacer rings are preferable, as shown in FIG. 4. The spacer rings 28 are spaced around the periphery of the shaft 27 on the pins 38, with the exterior surface of each ring adjacent the shaft 27. Each spacer ring is located equidistant from the center of the shaft 27. The centers of the spacer rings 28 form the corners of a square concentric with the shaft 27. The pins 38 act to retain the spacer rings 28 in position between the screen disks 14 when the screen disks are flexed to discharge a foreign object.

Figure 6:
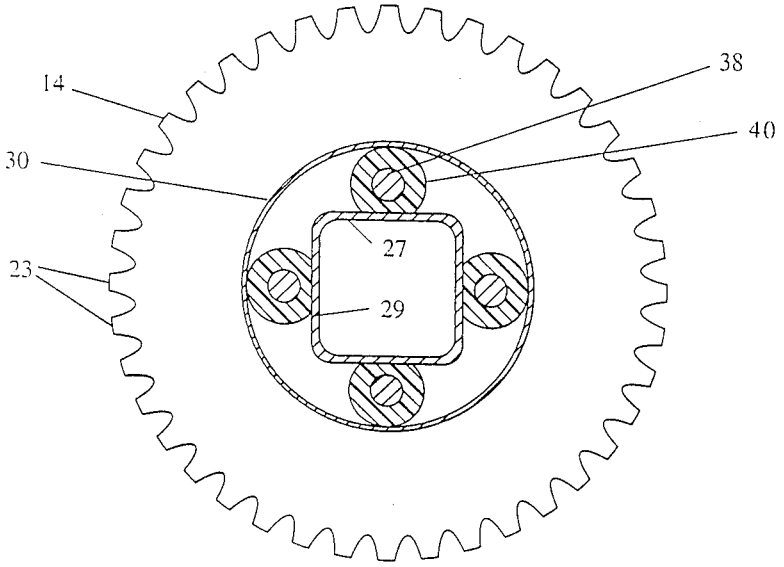
FIG. 6 is a cross-sectional view similar to FIG. 4, but showing a modified embodiment of the present invention.

As described previously herein, the spacer rings 28 are essentially cylindrical in shape, with a circular outer perimeter. However, the spacer may have other outer shapes, and particularly advantageously may employ a flat surface for engaging against the flat outer surface of the shaft 27. A spacer 40 employing a flat surface against the shaft 27 is shown in FIG. 6.

The screen disks 14 each have a central shaft receiving opening 29 sized and shaped to receive the shaft 27 with only a small space between the shaft 27 and the disks 14. The spacer rings 28 are located with relation to the shaft receiving openings by the pins 38 so that they can be slid over the shaft 27 which preferably is of a non-circular cross section, conveniently generally square, and which may be of any desired length, but is commonly about ten feet long to accommodate up to 144 screen disks 14. Shaft assemblies of this size are especially suitable for disk screens for screening wood chips as used in the paper making industry. When the spacer rings 28 are assembled on the pins 38 with the disks 14 and slid over the rectangular shaft 27, a fairly small sliding space occurs between the screen disks 14 and the shaft 27 but essentially the spacer rings 28 center the assembly on the shaft 27 so that stable positioning of the parts occurs during rotation, and vibration or oscillation is prevented.

The rectangular shaft 27 is suitably mounted on a rotational shaft, so that the entire unit will rotate in proper relationship to adjacent modular units as illustrated in FIG. 1.

In some screen disk applications it is desirable to avoid exposed plastic surfaces In such environments annular rings or surrounds 30 may be provided to encircle the sets of four spacer rings 28 between each pair of screen disks 14. The surrounds essentially close the space between the screen disks 14 and are supported on the spacer rings 28. The surrounds, in one form, are slightly shorter axially than the spacer rings 28, so that a space appears between the ends of the surrounds 30 and the surfaces of the adjoining screen disks 14. Thus, the outer surfaces of the plastic spacer rings 28 are fully protected from material between the disks so the abrasive materials, stones, and other debris do not chip or scratch the outer surfaces of the spacer rings 28. Furthermore, there is minimal exposed plastic which would be objectionable to some paper makers producing coated papers. By making the surrounds 30 slightly shorter in axial length than the spacer rings 28, the spacer rings can still function as elastic separators to permit deflection of the disks. To retain this function, the metal surrounds 30 must be sufficiently shorter in an axial dimension than the plastic spacer rings 28, so that even when the spacer rings 28 are compressed in their module form, there will still be a slight space at the ends of the metal surrounds 30, allowing the disks 14 to tilt slightly against the spacer rings 28. By properly sizing the metal surrounds 30, the screen disks 14 will be allowed to flex a certain degree, but will be restricted from flexing beyond that point. This allowable flexing permits the discharge of chips, rock and other objects, but limits the flexing so that the disks do not break or distort due to over bending. In a preferred form, the metal surrounds 30 are sized so that after the compression of the plastic spacer rings 28 there is still clearance of approximately 0.381 mm between the ends of the surround 30 and the disks 14. The compression of the plastic spacer rings 28 when the module is assembled also causes a slight radial expansion of the spacer rings which forces the spacer rings into a tight engagement with the surround 30 and the shaft 27.

In some installations, it is preferable that the surround 30 be loosely fitted over the spacer rings 28, even after any radial expansion of the spacer rings due to axial compression. This will allow the surround to move about the spacer rings to help discharge any objects wedged between adjacent screen disks.

While a preferred form of the surround 30 requires that it be slightly shorter than the spacer rings 28, such that when the spacer rings are placed under axial compression there will still be clearance at the end of the surround, in some forms it may be desirable to make the surround 30 of a length so that the screen disks 14 touch the end of the surround when the spacer rings 28 are compressed.

It should be noted that more than four spacer rings may be placed intermediate each pair of disk screens 14 to adequately and flexibly space the screen disks on shafts of non-square cross section. For example, it may be desirable to utilize five or more spacer rings adjacent to an elliptical or rectangular shaft. Any appropriate means known to the art for applying a compressive force to the module may be employed. Furthermore, the axial length of the spacer rings may be varied to provide disk screens of the desired dimension to accept or reject certain sized objects. Likewise, the screen disks may be larger or smaller than those shown in the preferred embodiment and may have teeth configured in a different manner, or no teeth at all.

It should be noted that screen disk modules may be constructed of any desired length, and that the screen disks and spacer rings may be of any desired diameters to appropriately screen out material of a determined size.

It is understood that the invention is not confined to the particular construction and arrangements of parts herein illustrated and described but embraces such modified forms thereof as come within the scope of the following claims.

I claim:

1. A disk screen rotatable shaft assembly, comprising:

an elongate metallic shaft member;

a plurality of screen disks mounted co-rotatively on the shaft member and having central shaft-receiving openings complementary to the shaft member with the disks mounted in spaced relation axially along the shaft member, adjacent disks of said plurality of screen disks defining disk pairs;

at least three uniform non-metallic resilient spacer rings disposed between adjacent disks defining disk pairs, said spacer rings being evenly spaced from each other along the periphery of the shaft radially outwardly from and adjacent the shaft, and accommodating limited tilting of the disks relative to the axis of the shaft with deflection of the spacer rings;

pins axially extending through the disks and the spacer rings and compressively connecting the disks and spacer rings together into a modular unit supported on the shaft member.

2. A disk screen rotatable shaft assembly as defined in claim 1 and including a single annular metallic surround between adjacent disks defining a disk pair, said surround encircling all of said spacer rings between said disk pair.

3. A disk screen rotatable shaft assembly as defined in claim 2 in which said annular metallic surround is less in axial length than the axial length of each of said spacer rings.

4. A disk screen rotatable shaft assembly as defined in claim 1 in which a metallic sleeve is provided over each of said non-metallic resilient spacer rings.

5. A disk screen rotatable shaft assembly as defined in claim 1 in which said spacer rings have a flat outer surface for engagement against a flat surface of said shaft member.

6. A disk screen rotatable shaft assembly comprising:

an elongate metallic shaft member;

a plurality of screen disk pairs mounted co-rotatively on the shaft member and having central shaft-receiving openings complementary to the shaft member, with the disks mounted in spaced relation axially along the shaft member;

at least three non-metallic spacer rings spaced around the periphery of the shaft and adjacent the shaft and between the disks of each disk pair, accommodating limited tilting of the disks relative to the axis of the shaft with deflection of the spacer rings;

annular metallic surrounds mounted between each pair of screen disks and encircling all the spacer rings between each pair of screen disks and having an axial dimension slightly less than the spacer rings, so that the spacer rings accommodate tilting of the disks without constraint from the surround;

pins axially extending through the disk pairs and the spacer rings; and means for axially compressively connecting the disks and spacer rings together and for expanding the spacer rings radially against the surround to secure the disks, spacers, and surrounds into a modular unit supported on the shaft member.

7. A disk screen rotatable shaft assembly of the type having an elongate metallic shaft member, a plurality of screen disks mounted co-rotatively on the shaft member and having central shaft-receiving openings with the disks mounted in spaced relation axially along the shaft member, with adjacent disks defining disk pairs, wherein the improvement comprises:

at least three uniform non-metallic compressible annular spacer rings disposed between disks of a disk pair at the periphery of the shaft and adjacent to the shaft, said spacer rings accommodating limited tilting of the disks relative to the axis of the shaft with deflection of the spacer rings; and pins axially extending through the spacer rings and the screen disks; and means for compressively connecting the disks and spacer rings together into a modular unit supported on the shaft member.

8. A module for a disk screen rotatable shaft assembly, comprising:

a plurality of screen disks having central shaft-receiving openings;

at least three uniform non-metallic resilient annular spacer rings between adjacent disks defining a disk pair, said spacer rings being disposed at, outwardly from and adjacent edges of said shaft-receiving openings, said spacer rings accommodating limited tilting of the disks relative to the axis of the disks with deflection of the spacer rings;

pins axially extending through the disks and the spacer rings and compressively connecting the disks and spacer rings together into a modular unit to facilitate mounting on a shaft.

9. A module for a disk screen rotatable shaft assembly as defined in claim 8 and further comprising a metallic surround encircling said non-metallic resilient annular spacer rings.

10. A module for a disk screen rotatable shaft assembly as defined in claim 8 wherein flat surfaces are provided on the perimeters of said spacer rings for engagement against a shaft disposed in the shaft-receiving opening.

11. A module for a disk screen rotatable shaft assembly as defined in claim 10 and further comprising a metallic surround encircling said non-metallic resilient annular spacer rings.

* * * * *